United States Patent [19]

Shroeder

[11] Patent Number: 5,033,984

[45] Date of Patent: Jul. 23, 1991

[54] ILLUMINATED MARKER BUOY

[76] Inventor: Hugh I. Shroeder, 2½ Wood River Rd., Dillingham, Ak. 99576

[21] Appl. No.: 526,158

[22] Filed: May 18, 1990

[51] Int. Cl.[5] ..... B63B 21/52

[52] U.S. Cl. ..... 441/16

[58] Field of Search ..... 441/6, 11, 13, 16, 17, 441/18

[56] References Cited

U.S. PATENT DOCUMENTS

| | | | |
|---|---|---|---|
| 1,374,942 | 4/1921 | Melvin . | |
| 1,481,583 | 9/1923 | Anundi . | |
| 1,796,460 | 3/1931 | Jackson . | |
| 2,765,481 | 10/1956 | Manhart et al. | 441/17 |
| 2,832,968 | 5/1958 | Knudsen | 441/16 |
| 3,071,788 | 1/1963 | Nelson | 9/8.3 |
| 3,592,157 | 7/1971 | Schwartz | 441/16 |
| 3,698,025 | 10/1972 | Worobel | 9/8.3 |
| 4,544,364 | 10/1985 | Bankston | 441/16 |
| 4,736,205 | 4/1988 | Dodge | 441/16 |

*Primary Examiner*—Sherman D. Basinger
*Assistant Examiner*—Stephen P. Avila
*Attorney, Agent, or Firm*—Ward Brown; Robert W. Beach

[57] ABSTRACT

A spherical buoy of translucent plastic material has a circular cutout leading to the open interior of the buoy. A cylindrical insert having a closed inner end portion and an open unobstructed interior is inserted into the cutout. The outer end portion of the insert is bonded to the margin of the cutout. A self-contained battery-operated light is actuated and inserted into the insert whereupon the outer end of the insert is closed by a screw cap to retain the actuated light in the insert. The insert is of light transmissive material such that the buoy is illuminated from the interior.

9 Claims, 1 Drawing Sheet

ILLUMINATED MARKER BUOY

BACKGROUND OF THE INVENTION

1. Field of the Invention

The present invention relates to nautical buoys.

2. Prior Art

Nautical marker buoys having electric lights are disclosed in the following U.S. Pat. Nos.:

1,374,942, issued Apr. 19, 1921 (Melvin);
1,481,583, issued Jan. 22, 1924 (Anundi);
1,796,460, issued Mar. 17, 1931 (Jackson);
3,071,788, issued Jan. 8, 1963 (Nelson);
3,698,025, issued Oct. 17, 1972 (Worobel).

As illustrated by the above patents, there have been efforts to provide a practical illuminated nautical marker buoy for a considerable length of time. The buoys disclosed in the above patents have ballast or are otherwise of specialized construction to maintain the buoys and their lights in a desired orientation, and more or less complicated internal workings or specialized constructions in order that the electric light can be incorporated in or supported by the buoy.

U.S. Pat. No. 4,291,484, issued Sept. 29, 1981, to Young discloses an illuminated fishing float or bobber and in the "Description of the Prior Art" refers to other such devices, but that patent does not pertain to a nautical marker buoy.

SUMMARY OF THE INVENTION

The principal object of the present invention is to provide a novel illuminated nautical marker buoy of simple inexpensive construction but reliable and durable over a long period of use and having familiar standard components easily recognized, maintained and repairable by fishermen and boaters.

In the preferred embodiment of the present invention, the foregoing objects are accomplished by providing a substantially transparent or translucent insert for a translucent hollow nautical marker buoy which insert has an internal cavity sized to hold a self-contained battery-powered light. The insert can have an inner cylindrical portion configured to be screwed into a plastic fitting which, in turn, is snugly received in a circular cutout of the shell of the buoy. By rapidly turning the insert in the cutout, a waterproof friction bond can be formed. Access to the interior of the insert is by a threaded cap for easy insertion and removal of the self-contained light.

DETAILED DESCRIPTION

Figure 1:
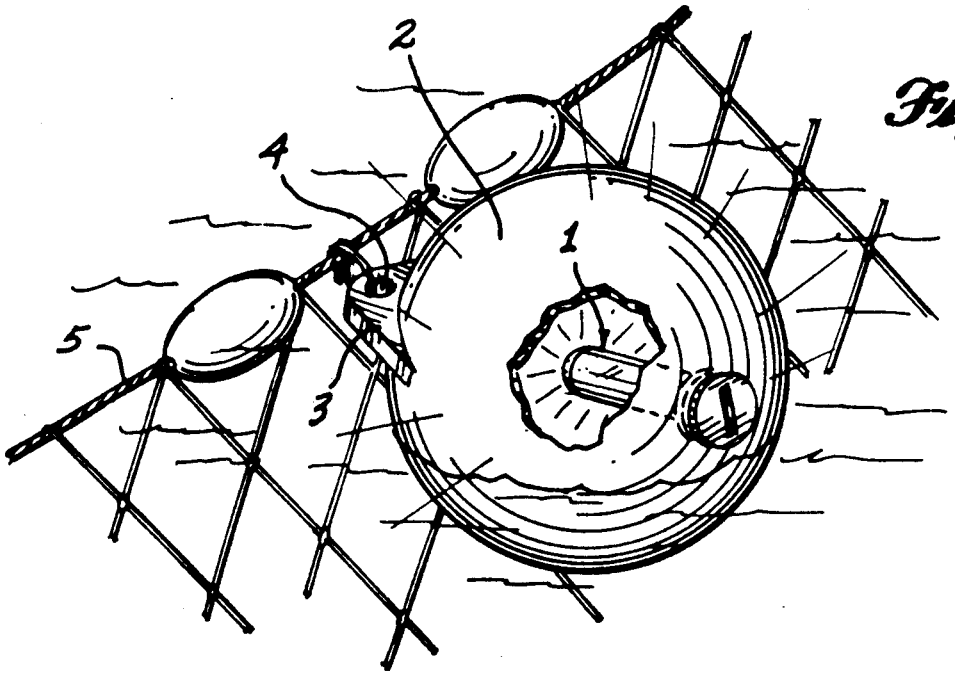
FIG. 1 is a somewhat diagrammatic top perspective of an illuminated nautical marker buoy in accordance with the present invention secured to the float line of a fishing net assembly.

With reference to the drawings, in accordance with the present invention a cylindrical insert 1 is incorporated in a hollow buoy 2 which preferably is of translucent rigid plastic material. The buoy can be approximately 18 inches in diameter and the insert preferably extends about halfway into the buoy. Buoy 2 can have a projecting ear 3 with an eye 4 for easy connection to the float line 5 of a fishnet assembly, or for any other desired use for a nautical marker buoy.

Figure 2:
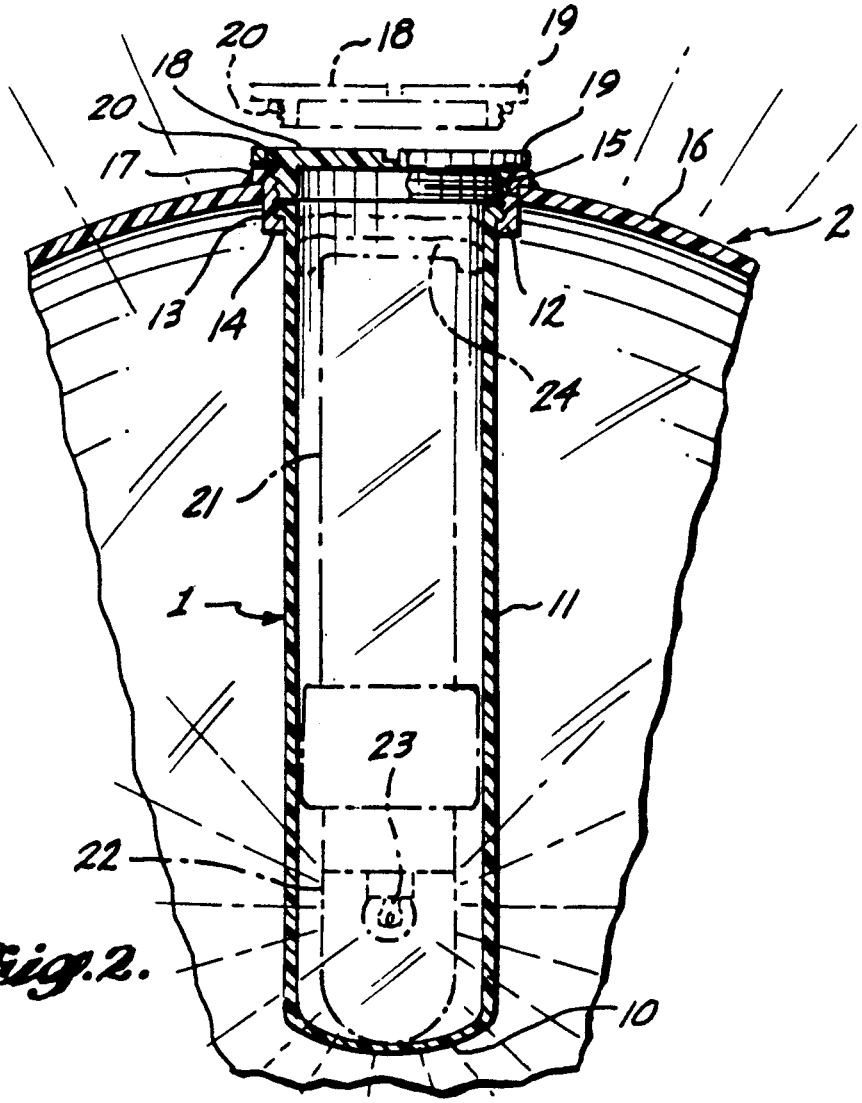
FIG. 2 is an enlarged fragmentary central transverse section of such buoy.

As shown in FIG. 2, the inner portion of the insert 1 has a generally hemispherical closed bottom 10 and a long cylindrical peripheral sidewall 11 leading to a top outward-projecting lip 12 having external threads. Such threads mate with the internal threads of a fitting 13 having an inward-extending bottom annular flange or lip 14 for tight engagement by the insert lip 12. Fitting 13 is snugly received in a complementally shaped bore 15 through the translucent generally spherical wall or shell 16 of the hollow buoy 2. Insertion of the fitting into the buoy is limited by an outer annular flange 17 of the fitting engaged against the exterior of the buoy shell 16.

Preferably the fitting and buoy are of compatible meltable plastic materials such that the insert 1 can be secured in the buoy by a friction bond formed by rapidly spinning the fitting in the buoy bore 15 to achieve melting of the plastic material which then solidifies for a permanent waterproof fit.

The open outer end of the fitting can be closed by a screw cap 18 having an outer annular radial flange 19 overlying the flange 17 of the fitting. A resilient gasket or rubber O-ring 20 is interposed between such flanges for an airtight and waterproof fit when the cap 18 is screwed into the fitting.

Nevertheless, the cap 18 can be quickly and easily removed, thereby exposing the open and unobstructed interior of the insert 1. Such insert is sized to receive a standard self-contained battery-powered light having a casing 21 supporting a bulb 23 and containing batteries for powering the bulb, such as a standard self-contained marine light of the type having a transparent dome 22 enclosing the bulb 23 for radiation of light in all directions, as compared to standard self-contained flashlights intended to shine a beam of light generally axially away from the body of the flashlight. The light sold under the trademark "SCOTTY" available from Marine & Fishing Products of Victoria, British Columbia, Canada, is acceptable for use in the present invention.

After actuation of the self-contained light 21, it can be quickly and easily fitted into the insert and sealed therein by the cap 18. A resilient pad 24 can be interposed between the cap and the adjacent end of the light to hold the light securely in position with its bulb 23 at approximately the center of the spherical buoy. When the buoy is retrieved, the cap can be removed to turn off the light, or the light can be of the type having a sensor so that power to the bulb is automatically cut off during the daytime.

The improved buoy in accordance with the present invention does not require specialized lights, wiring or switches, but is adaptable to different types of standard lights and, therefore, does not require complicated construction or specialized maintenance.

I claim:

1. A nautical marker buoy for receiving a self-contained battery-powered light having a casing supporting a bulb and containing batteries for powering the bulb, said buoy comprising a hollow shell of translucent material having a cutout, an elongated insert having a closed inner end, an open outer end and a continuous sidewall extending between said inner and outer ends defining an unobstructed interior cavity sized for reception of the entire self-contained battery-powered light, said insert being secured in said cutout of said shell with the inner end of said insert received in the interior of said shell and the outer end portion of said insert supported on said shell, and cap means separate from said self-contained battery-powered light for closing the open outer end of said insert for enclosing and retaining the self-contained battery-powered light therein but manually detachable from said insert for removal of said self-contained battery operated light in its entirety, said insert being transmissive of light whereby, with said light received in said insert and actuated, said shell is illuminated by transmission of light through said insert into the interior of said shell.

2. The buoy defined in claim 1, in which the insert includes an elongated inner portion having the closed inner end, an open outer end and the continuous sidewall extending between the closed inner end and said open outer end, said insert further including a fitting having an open outer end and an inner end forming an opening for closely receiving the sidewall of said insert by sliding movement of said insert inner portion into said fitting, said insert inner portion being secured in said insert fitting and said fitting being received in the cutout of the shell and being bonded therein.

3. The buoy defined in claim 2, in which the outer end portion of the insert inner portion has an outward-projecting flange and the inner end portion of the insert fitting having an inward-projecting lip, said flange and said lip being engaged to limit insertion of the insert inner portion into the insert fitting.

4. The buoy defined in claim 2, in which the outer end portion of the fitting has an outward-projecting flange limiting insertion of the fitting into the cutout of the shell.

5. The buoy defined in claim 4, in which the fitting is bonded in the shell cutout by a friction bond formed by spinning the fitting in the cutout.

6. The buoy defined in claim 3, in which the fitting has internal threads and the outward-projecting flange of the insert inner portion has external threads mating with said internal threads of the fitting.

7. The buoy defined in claim 6, in which the sealing means includes a screw cap having an externally threaded portion for mating with the internal threads of the fitting for closing the open outer end of the fitting.

8. The buoy defined in claim 7, in which the screw cap has an outward-projecting flange overlying the outer end of the fitting, and including a resilient member interposed between and compressed by engagement between said cap flange and the outer end of the fitting for a watertight fit of the cap relative to the fitting.

9. The buoy defined in claim 1, in which the shell is substantially spherical and the inner end portion of the insert is disposed approximately at the center of the shell.

* * * * *

UNITED STATES PATENT AND TRADEMARK OFFICE

CERTIFICATE OF CORRECTION

PATENT NO. : 5,033,984

DATED : July 23, 1991

INVENTOR(S) : Hugh I. SCHROEDER

It is certified that error appears in the above-identified patent and that said Letters Patent is hereby corrected as shown below:

On the title page, in the heading and in section [76], the inventor's last name is spelled incorrectly. The correct spelling of the inventor's last name is

--SCHROEDER--.

Signed and Sealed this

Tenth Day of November, 1992

*Attest:*

DOUGLAS B. COMER

*Attesting Officer*

*Acting Commissioner of Patents and Trademarks*